US006019092A

United States Patent [19]

Gilligan

[11] Patent Number: 6,019,092

[45] Date of Patent: Feb. 1, 2000

[54] FUEL CONDITIONING DEVICE

[75] Inventor: Michael Gilligan, Lyme Regis, United Kingdom

[73] Assignee: Fuelsaver Overseas Limited, United Kingdom

[21] Appl. No.: 09/075,017

[22] Filed: May 8, 1998

[30] Foreign Application Priority Data

May 17, 1997 [GB] United Kingdom ..... 9709960

[51] Int. Cl.[7] ..... F02B 75/12

[52] U.S. Cl. ..... 123/538

[58] Field of Search ..... 123/536, 537, 123/538; 210/222

[56] References Cited

U.S. PATENT DOCUMENTS

| | | | |
|---|---|---|---|
| 1,688,613 | 10/1928 | Cogan . | |
| 1,885,559 | 11/1932 | Smith . | |
| 2,632,296 | 3/1953 | Houdry | 123/536 |
| 3,134,655 | 5/1964 | Boucher . | |
| 3,805,492 | 4/1974 | King | 123/537 |
| 3,871,624 | 3/1975 | Huber et al. . | |
| 4,251,031 | 2/1981 | Martin et al. . | |
| 4,590,915 | 5/1986 | Yamauchi et al. . | |
| 4,643,584 | 2/1987 | Allocca . | |
| 4,930,483 | 6/1990 | Jones . | |
| 5,069,191 | 12/1991 | Scouten . | |
| 5,249,552 | 10/1993 | Brooks | 123/538 |
| 5,393,723 | 2/1995 | Finkl | 123/538 |
| 5,404,913 | 4/1995 | Gilligan . | |
| 5,533,490 | 7/1996 | Pascall | 123/538 |

*Primary Examiner*—Marguerite McMahon
*Attorney, Agent, or Firm*—Ira S. Dorman

[57] ABSTRACT

A ferrous metal housing 1 has an inlet 4 and an outlet 5 at opposite ends. A series of alloy discs 6 are carried on a shaft 7 within the housing, separated by spacers 8. The discs each contain a ring of circular apertures, and the shaft 7 is supported by skeletal spacers 9 and 10 to leave a gap between the periphery of the spacers and the wall of the housing. A ferrite magnet 14 of square outline is supported by the walls of the housing 1 at the outlet end, leaving four gaps between the sides of the magnet and the housing. The device is capable of maintaining high flow rates whilst producing a turbulence pattern which ensures good fuel conditioning.

12 Claims, 2 Drawing Sheets

FUEL CONDITIONING DEVICE

TECHNICAL FIELD OF THE INVENTION

This invention relates to a device for conditioning hydrocarbon fuel to improve its combustion characteristics. The device is applicable to petrol (leaded and unleaded) and diesel engines.

BACKGROUND

Such devices are well known and generally include an alloy body and a magnetic core. Although the way in which such devices work is not fully understood, the advantages are well documented, and include:

Reduced fuel consumption (more kilometers per liter of fuel).

Increased engine power.

Reduced corrosion and engine wear.

Reduced emission of unburnt hydrocarbons, CO and NOx.

Many forms of the device are specifically designed to operate with small capacity engines which have relatively low rates of fuel flow. The designs do not generally work efficiently with large engines having a high rate of flow.

The present invention seeks to provide a new and inventive form of fuel conditioning device which is suitable for use in ships and similar large craft having a high rate of fuel consumption.

SUMMARY OF THE INVENTION

The present invention proposes a fuel conditioning device comprising an elongate housing having a fuel inlet at one end and a fuel outlet at the other, the housing containing a magnet and a plurality of fuel conditioning plates carried on a support shaft which extends along the housing, said plates comprising an alloy of tin, and including a plurality of apertures for fuel to pass through, the plates being mutually spaced and being held clear of the internal surface of the housing to provide a substantially linear flow path between the outer periphery of the plates and the housing.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
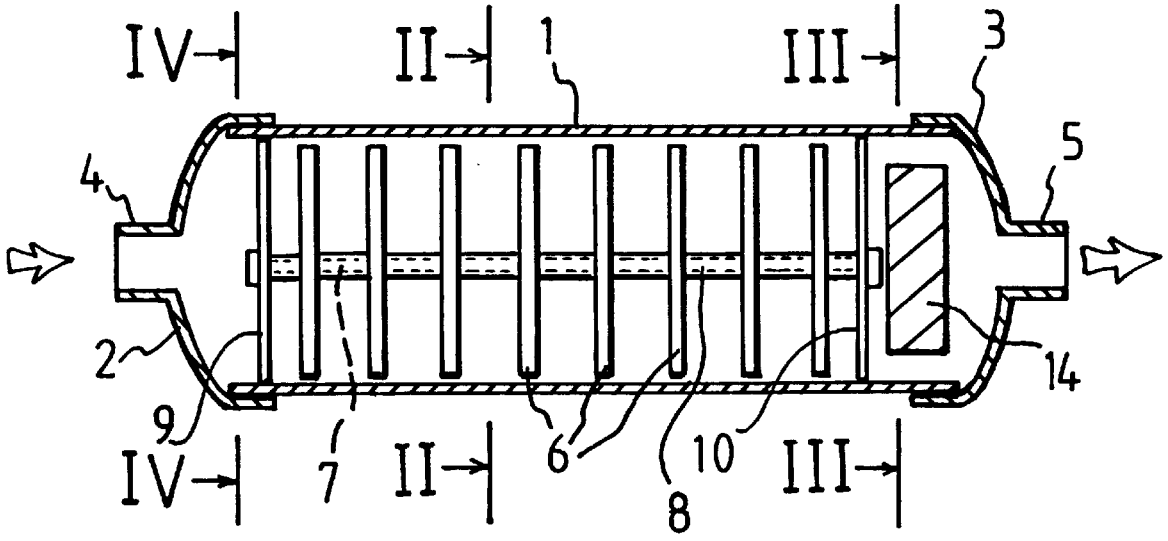
FIG. 1 is a longitudinal section through a fuel conditioning device in accordance with the invention.
Figure 2:
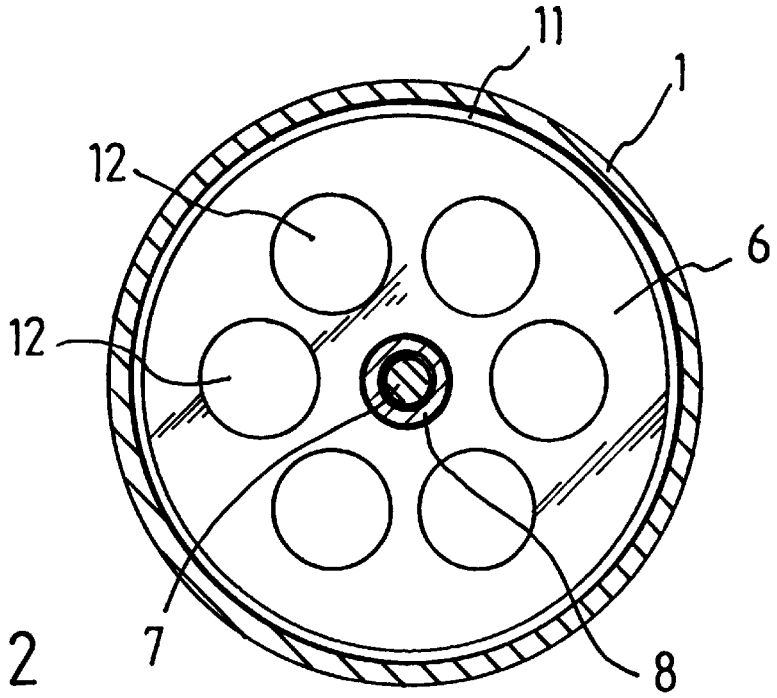
FIG. 2 is section II—II of FIG. 1.
Figure 4:
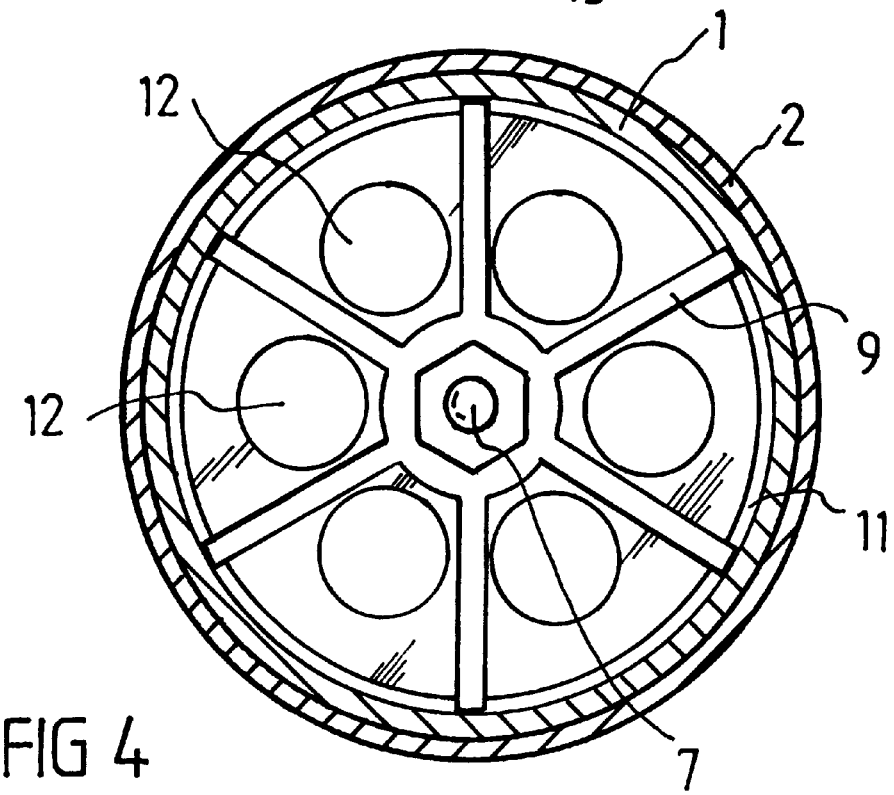
FIG. 4 is section IV—IV of FIG. 1.

The device comprises a ferrous metal cylindrical housing 1 having end caps 2 and 3 provided with respective fuel inlet and outlet connections 4 and 5 so that the device can be coupled into the fuel line of a ships engine or aircraft engine for example, close to the fuel pump. A series of parallel disc-shaped cores 6 (in this case eight) are supported within the housing on a shaft 7, separated by suitable spacing means 8. The shaft is supported co-axially within the housing by a pair of skeletal spiders 9 and 10 (FIG. 4), such that the discs are held off the internal wall of the housing 1 leaving a gap 11 (FIG. 2).

Each core 6 is cast of a tin alloy of a composition known for use in fuel conditioning devices, and includes a number of apertures 12 (in this instance six) arranged in a ring co-axial with the shaft 7. The apertures are equally spaced circumferentially of the disc, as shown.

Figure 3:
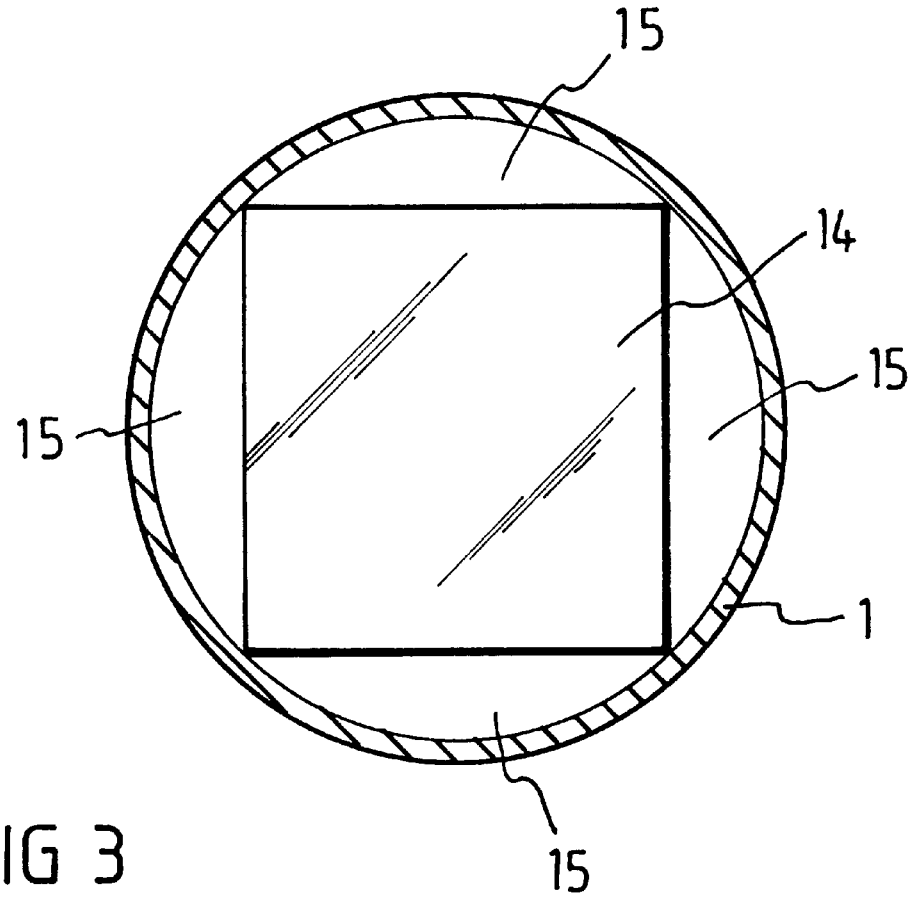
FIG. 3 is section III—III of FIG. 1.

At the outlet end, the housing contains a strong ferrite magnet 14 to subject the fuel to a high magnetic field. As shown in FIG. 3, when viewed on a transverse section through the housing 1, the magnet is of square or rectangular section and is supported with its corners in contact with the walls of the housing 1, thereby leaving four chordal gaps 15 through which the fuel can flow.

When fuel flows through the inlet 4 it passes through the first spider 9 and thence through the apertures 12 in the discs 6. Turbulence is created in the fuel flowing through the discs without significantly reducing the rate of flow. In this respect it does not appear to be important whether the apertures are aligned or not. However, there is also a linear flow through the gap 11 between the inside of the housing 1 and the periphery of the discs 6, which is important to the fuel conditioning process, since the fuel consumption returns towards normal if the gap is not present. After passing through the second spider 10 the fuel flows around the ferrite magnet 14 before travelling to the engine via the outlet 5.

With the device in line the fuel consumption of the engine is significantly reduced, typically by 15% or more, without significantly restricting the fuel flow.

The number of apertures 12 in the discs 6 can vary. In devices designed for a particularly high fuel flow the apertures may be arranged in several concentric rings. In addition, more than one shaft 7 could be used to support the discs 6.

It will be appreciated that the features disclosed herein may be present in any feasible combination. Whilst the above description lays emphasis on those areas which, in combination, are believed to be new, protection is claimed for any inventive combination of the features disclosed herein.

What I claim is:

1. A fuel conditioning device comprising:

an elongate housing having an internal surface, with a fuel inlet and a fuel outlet at opposite ends of said housing;

magnet means contained within the housing;

a plurality of fuel conditioning plates disposed transversely within said housing, said plates comprising an alloy of tin and each including a plurality of apertures for fuel to pass through;

a support shaft which extends lengthwise of the housing and supports said plates clear of said internal surface of the housing to provide a substantially linear flow path between the plates and said internal surface; and spacer means for mutually spacing said plates on said support shaft.

2. A fuel conditioning device in accordance with claim 1, including a substantially uniform gap between the periphery of each plate and said internal surface of the housing.

3. A fuel conditioning device in accordance with claim 1, including a pair of skeletal spiders which support opposite ends of said support shaft.

4. A fuel conditioning device in accordance with claim 1, in which said spacer means are carried on said support shaft.

5. A fuel conditioning device in accordance with claim 1, in which said apertures are arranged in a ring.

6. A fuel conditioning device in accordance with claim 5, in which said ring of apertures is substantially symmetrical about the geometrical centre of the respective plate.

7. A fuel conditioning device in accordance with claim 5, in which said apertures are mutually equally spaced.

8. A fuel conditioning device in accordance with claim 1, in which each of said apertures is substantially circular.

9. A fuel conditioning device in accordance with claim 1, in which each of said plates is substantially circular.

10. A fuel conditioning device in accordance with claim 1, in which said housing is substantially cylindrical.

11. A fuel conditioning device in accordance with claim 10, in which said magnet is of square or rectangular outline when viewed on a transverse section through said housing.

12. A fuel conditioning device in accordance with claim 1, in which said housing comprises a ferrous metal.

* * * * *